US008177267B2

(12) United States Patent
Kuehn

(10) Patent No.: US 8,177,267 B2
(45) Date of Patent: May 15, 2012

(54) DOOR ANTI-LATCH DEVICE

(76) Inventor: Thomas Merrill Kuehn, Turnwater, WA (US)

( * ) Notice: Subject to any disclaimer, the term of this patent is extended or adjusted under 35 U.S.C. 154(b) by 580 days.

(21) Appl. No.: 12/174,593

(22) Filed: Jul. 16, 2008

(65) Prior Publication Data

US 2009/0039659 A1 Feb. 12, 2009

Related U.S. Application Data

(60) Provisional application No. 60/959,895, filed on Jul. 16, 2007.

(51) Int. Cl.
*E05C 19/18* (2006.01)
*E05C 19/00* (2006.01)

(52) U.S. Cl. .. 292/288; 292/297; 292/298; 292/DIG. 15

(58) Field of Classification Search ..... 292/288, 292/297, 298, DIG. 15; 70/416–418
See application file for complete search history.

(56) References Cited

U.S. PATENT DOCUMENTS

| | | | | | |
|---|---|---|---|---|---|
| 869,541 | A | * | 10/1907 | Baxter | 292/297 |
| 960,521 | A | * | 6/1910 | Early | 292/298 |
| 970,273 | A | * | 9/1910 | Sorrow | 292/297 |
| 1,288,988 | A | * | 12/1918 | Reed | 292/297 |
| 1,406,085 | A | * | 2/1922 | Rouch et al. | 292/297 |
| 1,780,941 | A | * | 11/1930 | Pineo | 292/298 |
| 4,169,619 | A | * | 10/1979 | McCracken | 292/290 |
| 4,589,692 | A | * | 5/1986 | Boyd | 292/297 |
| 4,707,006 | A | | 11/1987 | Garg et al. | |
| 4,984,834 | A | * | 1/1991 | Nickels | 292/297 |
| 5,004,279 | A | | 4/1991 | Radcliff | |
| 5,772,265 | A | * | 6/1998 | Gilbert | 292/207 |
| 6,082,790 | A | | 7/2000 | Mossotti et al. | |
| 6,330,771 | B1 | | 12/2001 | Hester, Jr. | |
| 6,336,245 | B1 | | 1/2002 | Sakakibara | |
| 6,390,514 | B1 | | 5/2002 | Frolov | |
| 6,698,807 | B1 | | 3/2004 | Wacker | |
| 6,874,825 | B1 | * | 4/2005 | Rauner | 292/61 |
| 6,955,380 | B1 | * | 10/2005 | Barr | 292/84 |

* cited by examiner

*Primary Examiner* — Carlos Lugo
(74) *Attorney, Agent, or Firm* — Richard E. Oney; Tiffany & Bosco, P.A.

(57) ABSTRACT

A door anti-latch device includes a base mounted to a door or a door frame, and a lever rotatably mounted to the base so that the lever can rotate about a pivot point from an open position to a latching position. The lever includes a handle end and an opposing stop end. The lever can be rotated between the open position and the latching position by moving the lever handle. The lever stop prevents the door from latching when the lever is in the open position and will not prevent the door from latching when the lever is in the latching position. The door anti-latch device can be moved from the open position to the latching position without leaving the room or opening the door.

20 Claims, 5 Drawing Sheets

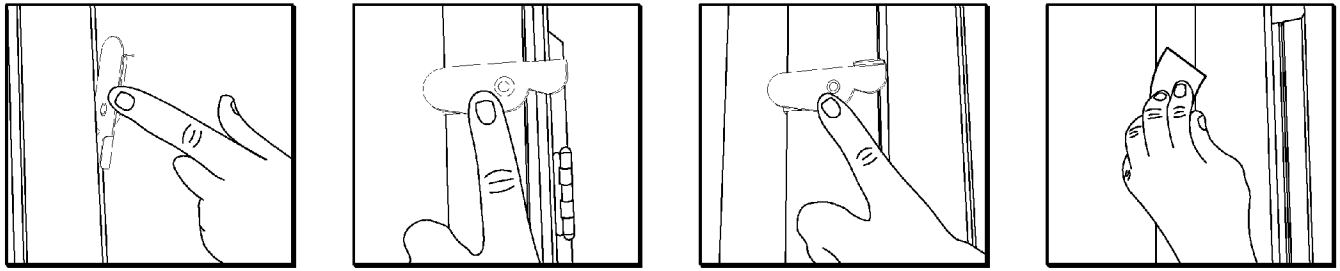
FIG. 8A
FIG. 8B
FIG. 8C
FIG. 8D
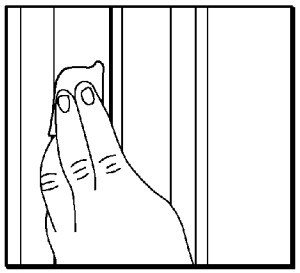
FIG. 8E
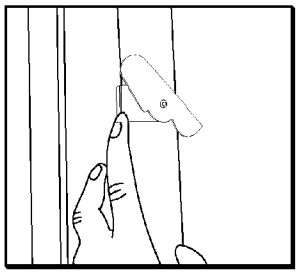
FIG. 8F
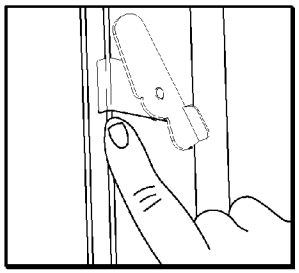
FIG. 8G
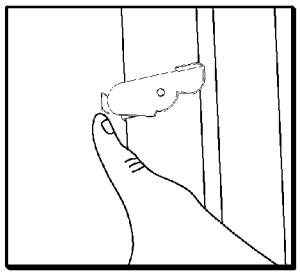
FIG. 8H
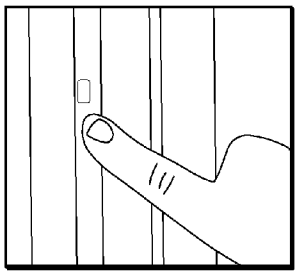
FIG. 8I
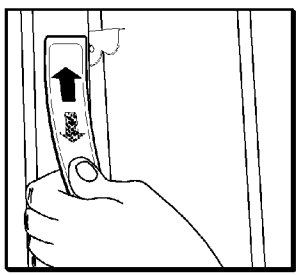
FIG. 8J
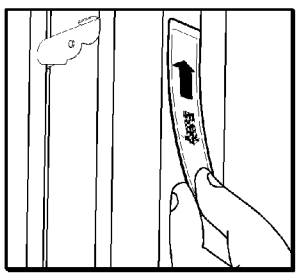
FIG. 8K

DOOR ANTI-LATCH DEVICE

RELATED APPLICATION DATA

This application claims the benefit of U.S. Provisional Application No. 60/959,895, filed Jul. 16, 2007, entitled "Door Anti-Latch Device (DAD)," which is incorporated herein by this reference.

BACKGROUND

This invention relates to door anti-latch devices. More particularly, it relates to a new door anti-latch device having a normal position, which allows a locked door to close but prevents the door strike from latching into the strike plate, and lockdown position that allows the locked door to latch. The device can be moved from the normal position to the lock-down position without leaving the room or opening the door.

Door anti-latch devices are known in the prior art. Such devices, however, have shortcomings in certain applications, such as schools where a "lockdown" procedure may be required. A "lockdown" is initiated during an emergency at a school where it is required that the students be locked in the classroom with the teacher as a protection from unauthorized and dangerous personnel. During a lockdown, the teacher's task is to lock the door, cover the windows, move the students to the safest area of the room and wait for an all clear. Because classroom doors are always left unlocked while class is in session, and the doors can only be locked from the outside, the teachers must carry their keys with them at all times and must go out in the hall to lock the doors. This puts a burden on the teacher to have their keys handy at all times and requires the teacher to open the door and leave the room to go out into the hall to lock the door.

It is an object of the present invention to provide an improved door anti-latch device that can be installed on a classroom door to quickly and easily secure the door from inside the classroom during a lockdown.

It is another object of the invention to provide a device that allows a door to be locked and latched quickly and easily without leaving the room or opening the door.

It is another object of the present invention to provide a door anti-latch device that is relatively easy and inexpensive to manufacture.

It is a further object of the present invention to provide a door anti-latch device that is durable and reliable.

It is yet another object of the present invention is to provide a door anti-latch device that is easy and inexpensive to install and can be used with existing door frames, whether the door opens into the room, into the hallway, or to the outside.

Additional objects and advantages of the invention will be set forth in the description that follows, and in part will be apparent from the description, or may be learned by practice of the invention. The objects and advantages of the invention may be realized and obtained by means of the instrumentalities and combinations pointed out in the appended claims.

SUMMARY OF THE INVENTION

To achieve the foregoing objects, and in accordance with the purposes of the invention as embodied and broadly described in this document, there is provided a door anti-latch device for preventing a door from latching. The device includes a base, means for mounting the base to a door or a door frame, and a lever. The lever is rotatably mounted to the base so that the lever can rotate about a pivot point from an open position (also referred to as a blocking position) to a latching position (also referred to as a non-blocking position). The lever includes a handle end and an opposing stop end. The lever can be rotated between the open or blocking position and the latching or non-blocking position by moving the lever handle. When the base is mounted to the door or door frame, the lever stop will prevent the door from latching (i.e., it will block the door from latching) when the lever is in the open position or blocking position and will allow the door to latch (i.e., it will not block the door from latching) when the lever is in the latching position or non-blocking position.

In one advantageous embodiment, the base and the lever each or in the form of an elongated plate. The base plate has a flange opposite the pivot point for contacting an edge of the door or door frame. The lever is generally parallel to the base in the open position and is generally perpendicular to the base in the latching position. The lever is rotatably mounted to the base with a rivet. The means for mounting the base to the door or the door frame includes adhesive tape mounted to the base. The base includes a projection for restricting the rotation of the lever to a range between the open position and the latching position. The lever includes a shoulder that cooperates with the base projection for restricting the range of rotation of the lever. The range of rotation of the lever is approximately 90 degrees.

In this configuration, the door anti-latch device can be moved from the open position to the latching position without leaving the room or opening the door.

BRIEF DESCRIPTION OF THE DRAWINGS

The accompanying drawings, which are incorporated in and constitute a part of the specification, illustrate the presently preferred embodiments and methods of the invention and, together with the general description given above and the detailed description of the preferred embodiments and methods given below, serve to explain the principles of the invention.

FIGS. 8A-8K illustrate the installation of the door anti-latch device of the present invention.

DESCRIPTION

Figure 1:
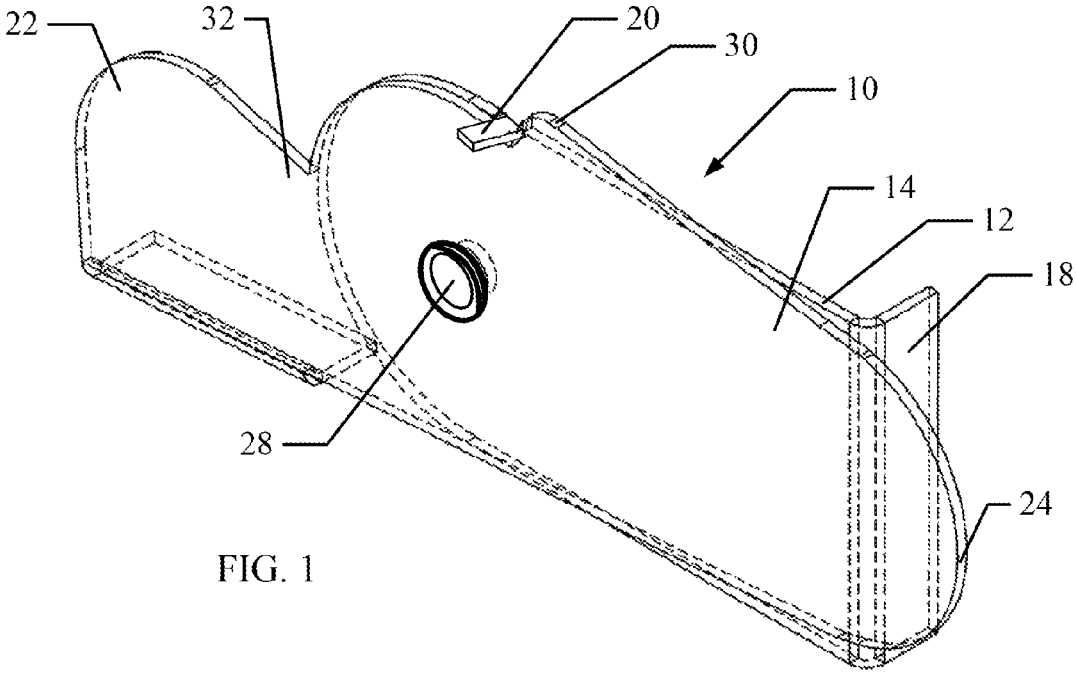
FIG. 1 is a perspective view of one embodiment of a door anti-latch device according to the present invention for use with a door that opens inward and has a right side hinge, showing the device in the open position.

Reference will now be made in more detail to presently preferred embodiments of the invention, as illustrated in the accompanying drawings. While the invention is described more fully with reference to these examples and drawings, the invention in its broader aspects is not limited to the specific details, representative devices, and illustrative examples shown and described. Rather, the description which follows is to be understood as a broad, teaching disclosure directed to persons of ordinary skill in the appropriate arts, and not as limiting upon the invention.

The door anti-latching device according to the present invention is designed to allow a door to close but to prevent the door strike from latching into the strike plate. The door lock can remain in the locked position, but because the door anti-latching device prevents it from latching, it allows free ingress or egress without having to turn the doorknob or lever handle, or depress the door crash bar.

Referring to FIGS. 1-5, a door anti-latch device 10 according to the present invention includes a base member 12 and a lever member 14 that is rotatably mounted to the base member 12. The base member 12 generally is in the form of an elongated plate with a hole 16 that defines a pivot point 17 and a flange 18 opposite the base member hole 16. The flange 18 abuts the edge of a door or door frame when the base member 12 is mounted, thereby assisting in holding the door anti-latch device in position, as discussed in more detail below. A projection 20 extends perpendicularly from the base member 12 in a direction opposite the flange 18. The base projection 20 restricts the range of rotation of the lever member 14, as discussed in more detail below. The anti-latch device 10 is installed on the inside of a room by mounting the base member 12 to the door edge opposite the hinges or the door jamb stop, depending upon which way the door swings. In one preferred embodiment, the base member 12 is mounted to the door or door frame using a high strength industrial adhesive, such as a VHB double backed tape with an exposed side attached to the base member 12. Upon reading this specification, however, it will be understood that other mounting means suitable for mounting a plate to a door or door frame may be used, such as screws, nails or the like.

Still referring to FIGS. 1-5, the lever member 14 also is generally in the form of an elongated plate with a handle end 22 and an opposing stop end 24. The handle end 22 includes a handle flange 25 to aid a user in gripping the lever member 14. A hole 26 is positioned to align with the base member hole 16. The lever member 14 is rotatably mounted to the base member 12 using a rivet 28 or other connector that allows for rotation of the lever member 14 relative to the base member 12. The lever member 14 can rotate about the pivot point 17 between a door-open position (see, e.g., FIG. 2) and a latching position (see FIG. 5) by moving the lever handle 22. Shoulders 30, 32 cooperate with the base projection 20 to restrict the range of rotation of the lever member 14. In this configuration, the lever member 14 is generally parallel to the base member 12 in the open position and is generally perpendicular to the base member 14 in the latching position, and the range of rotation is approximately 90 degrees. When the door anti-latch device 10 is in the door-open or "normal" position, the lever stop end 24 will engage the door frame or the door and hold the door slightly ajar so that it does not seat against the jamb, thereby preventing the door strike from latching. When the door anti-latch device 10 is in the latching or "lockdown" position, the lever stop end 24 will not engage the door frame or door, thereby allowing the door to latch normally. Pulling the handle end 22 down from the normal position to the lockdown position allows the door strike to latch in the strike plate, which immediately locks the door without having to use a key or exit the room.

In a preferred embodiment, the base member 12 and a lever member 14 are made of a flat material of suitable strength, such as sheet metal, stainless steel, plastic or similar material of suitable strength and thickness. The base member 12 and lever member 14 are then joined together with a swivel rivet inserted through the holes 16, 26.

Figure 6:
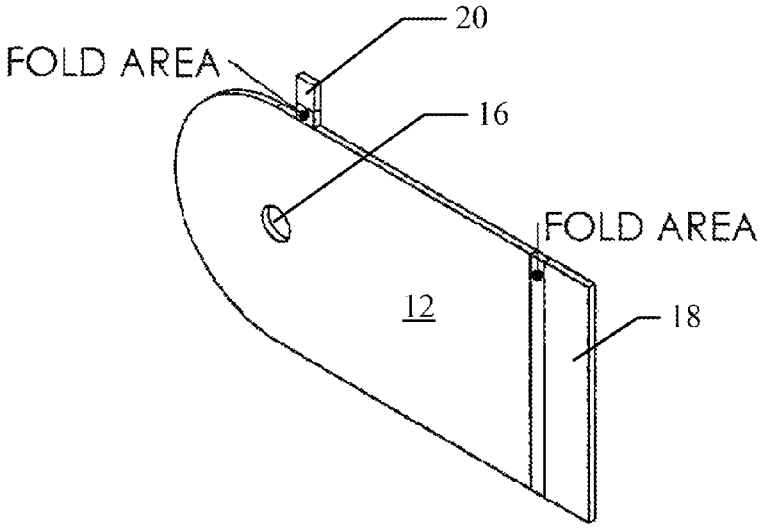
FIG. 6 is a perspective view of a universal base plate that can be used to manufacture any of the embodiments of the anti-latch devices of FIGS. 1-4.

In one exemplary embodiment, the base member 12 is cut from 1/16 inch thick sheet metal (see FIG. 6). The base member 12 is approximately 1.7 inches long and 1.0 inch wide. The base projection 20 is approximately 0.09 inch by 0.09 inch and is located 1.06 inches from the base flange 18. The flange 18 is approximately 0.25 inch wide. As shown in FIG. 6, the base projection 20 is formed by bending a tab along a fold area formed in the base plate 12 and the flange 18 is formed by folding the end of the base plate along a fold area. The base member hole 16 is positioned 1.25 inches from the flange 18 and has a 0.14 inch diameter. The base member end opposite the flange 18 is rounded with a 0.50-inch inch radius centered on the base member hole 16.

Figure 7:
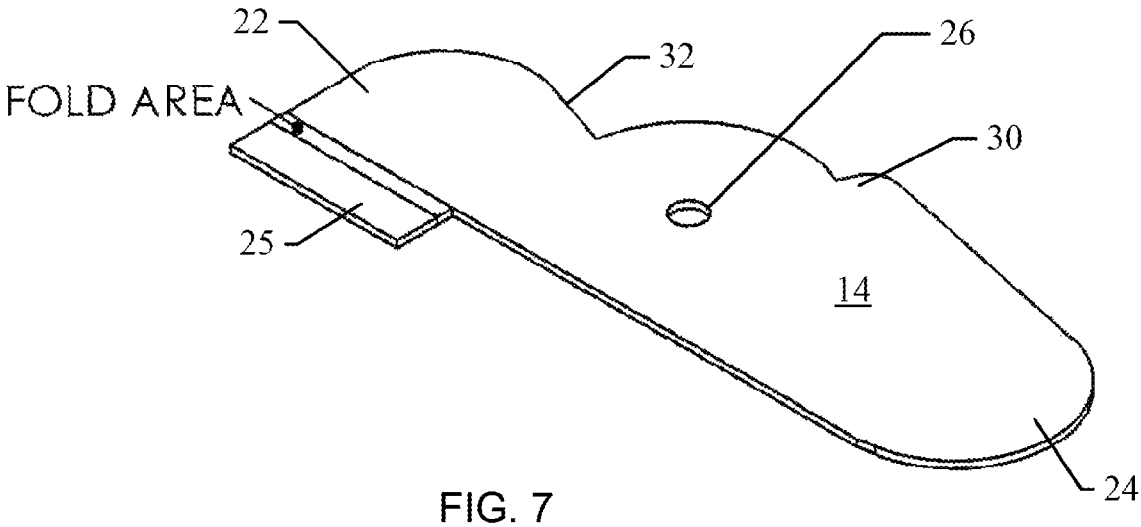
FIG. 7 is a perspective view of a universal lever plate that can be used to manufacture any of the embodiments of the anti-latch devices of FIGS. 1-4.

In this exemplary embodiment, the lever member 14 also is cut from 1/16 inch thick sheet metal (see FIG. 7). The lever member 14 is approximately 1.07 inches wide and 2.99 inches long. The stop end 24 is rounded with a 0.44 inch radius. The flange 25 on the handle end 22 is approximately 2.5 inches wide and is formed by bending a tab along a fold area as shown in FIG. 7. The lever member hole 26 is positioned approximately 1.30 inches from the edge of the handle end 22 and 0.50 inch from a straight edge of the lever member 14 opposite the shoulders 30, 32 and has a 0.14 inch diameter. The shoulders 30, 32 are formed on an edge of the lever member 14 that incorporates three curved portions connected by straight edge portions. The middle curved portions has a 0.50-inch inch radius centered on the lever member hole 26. One shoulder 30 is disposed between the hole 26 and the stop end 24 and is formed in part by a curve having a 0.10-inch radius. The other shoulder 32 is disposed between the handle end 22 and the hole 26 and is formed in part by a curve having a 0.40 inch radius.

Figure 2:
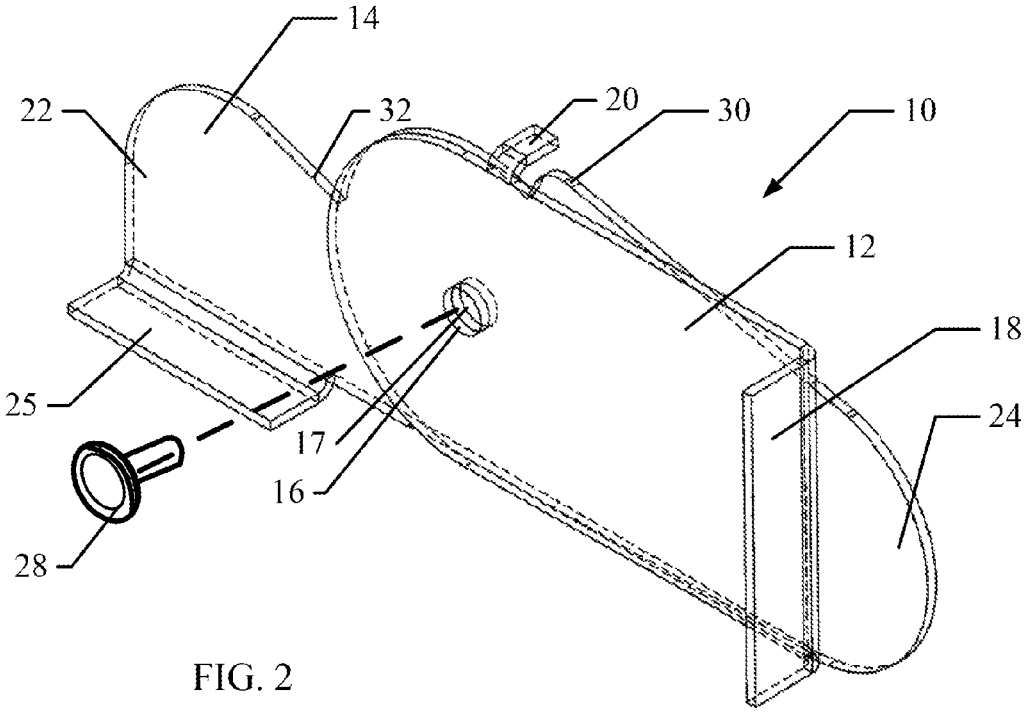
FIG. 2 is a perspective view of an embodiment of a door anti-latch device according to the present invention for use with a door that opens inward and has a left side hinge, showing the device in the open position.
Figure 3:
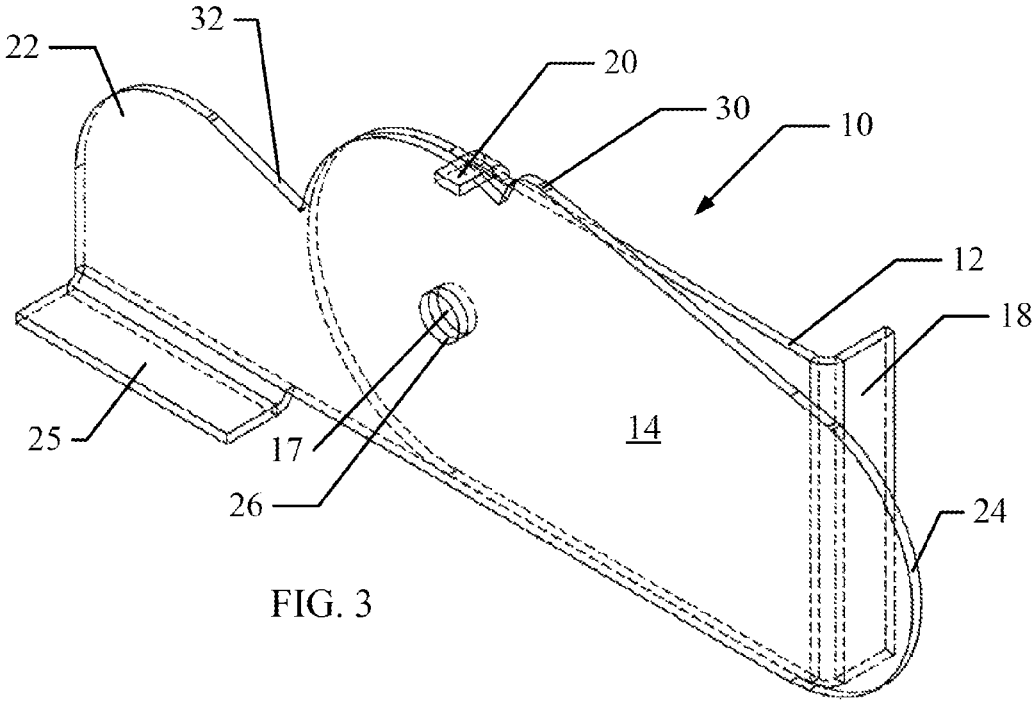
FIG. 3 is a perspective view of an embodiment of a door anti-latch device according to the present invention for use with a door that opens outward and has a right side hinge, showing the device in the open position.
Figure 4:
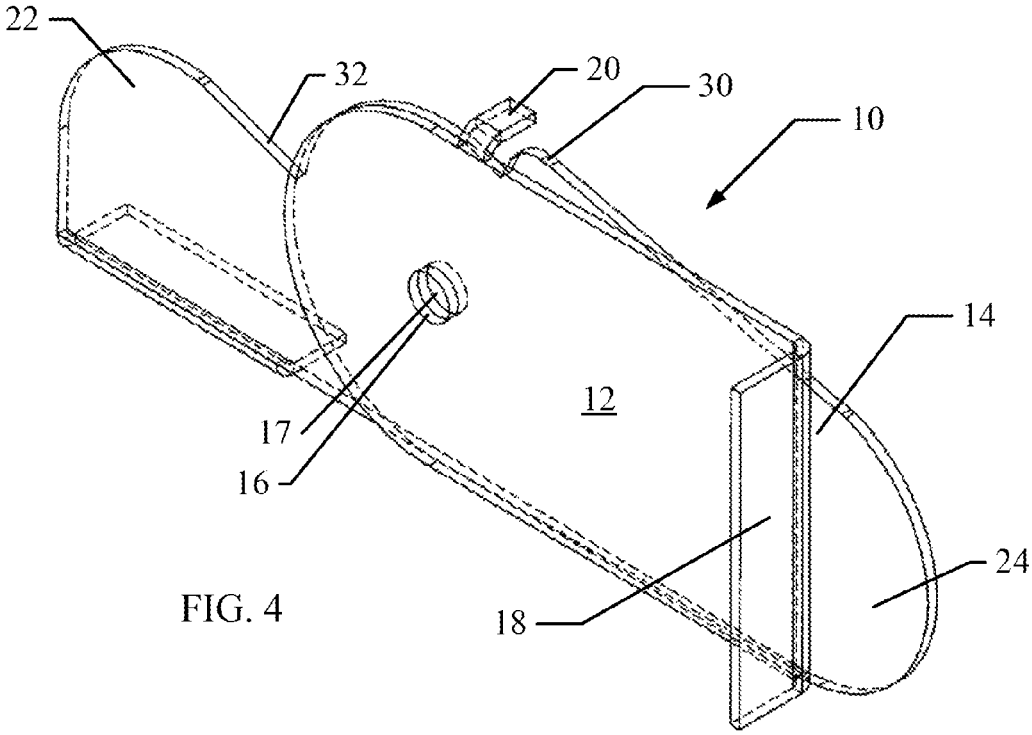
FIG. 4 is a perspective view of an embodiment of a door anti-latch device according to the present invention for use with a door that opens outward and has a left side hinge, showing the device in the open position.
Figure 5:
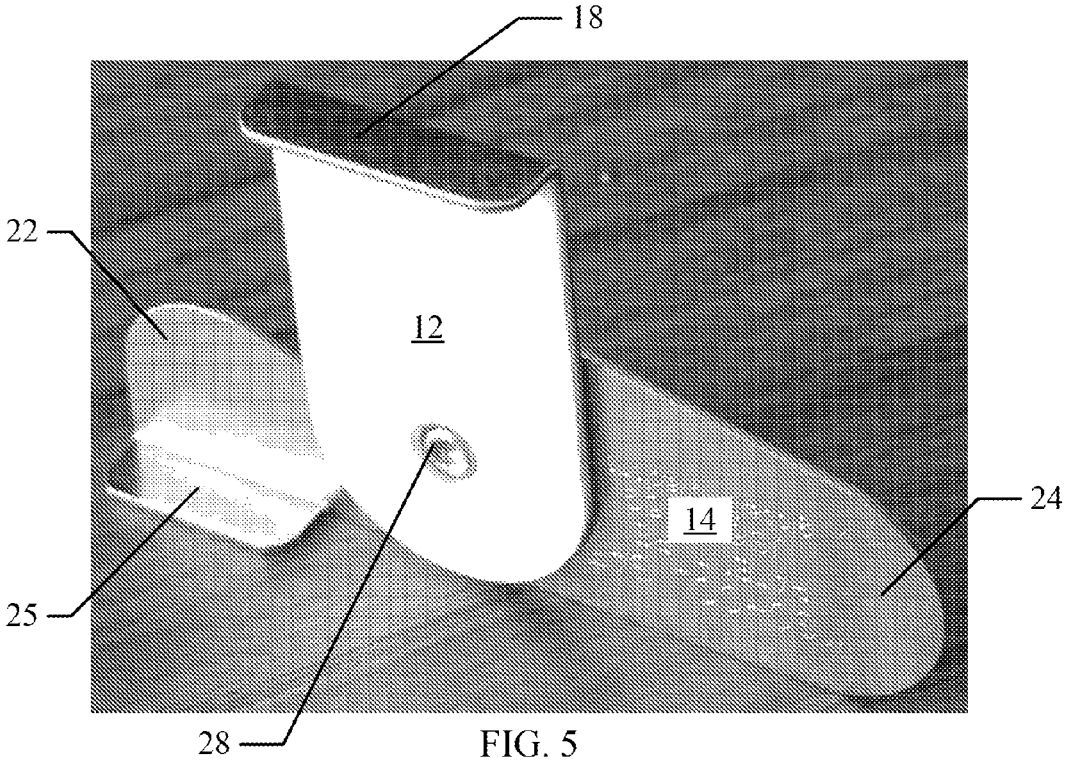
FIG. 5 is a perspective view of the door anti-latch device of FIG. 2, showing the device in the latching position.

According to one important aspect of the invention, the plate shapes shown in FIGS. 6 and 7 are universal, i.e. they can be used to assemble four different configurations of the anti-latch device 10, each of which can be used for a different door configuration. There are four different door configurations, i.e. when looking at a door from outside a room it can open into the room and have hinges on the left side (IL), it can open into the room and have hinges in the right side (IR), it can open out of the room and have hinges on the left side (OL), or it can open out of the room and have hinges in the right side (OR). For convenience, the device configurations that correspond to each of these door configurations will be referenced herein as IL, IR, OL and OR, respectively. The plates shown in FIGS. 6 and 7 can be used to manufacture different configurations of the anti-latch device 10 for use with each of these door configurations by bending the tabs for the base projection 20, base flange 18 and lever handle 25 in different directions and mounting the lever member 14 on a different side of the base member 12. For example, FIG. 1 shows the IR configuration, FIG. 2 shows the IL configuration, FIG. 3 shows the OR configuration and FIG. 4 shows the OL configuration, all of which are made with the universal base member 12 and lever member 14 shapes shown in FIGS. 6 and 7.

FIGS. 8A-8K illustrate the installation of the door anti-latch device 10 according to the present invention. Looking from the hall, if the door opens into the room the IL or IR configuration is used. If the door opens out toward to the hall, the OL or OR configuration is used. The IL and IR configuration are installed on the edge of the door on the side opposite the door hinges. The OL and OR configurations are installed on the jamb stop of the door frame on the side opposite the door hinges.

Whether the door anti-latch device 10 is installed on the door or on the jamb, it is preferable to mount the device a distance above the floor so that young children cannot reach it, e.g. approximately six feet from the floor. Before installation of the IL and IR configurations, the installer should check to make sure that there is enough clearance between the door and the jamb when the door is closed so that the door does not become stuck in the closed position (see FIG. 8A). There is no need to check for clearance when installing the OL or OR configurations. If there is not sufficient clearance, the door anti-latch device 10 can be installed lower on the jamb, or the door may need to be sanded or planed to provide sufficient clearance. The door anti-latch device 10 is installed with the lever handle 25 on the inside of the room and the lever stop end 24 pointed towards the hall (see FIG. 8B). The device can be mounted using a suitable adhesive, such as with a double-sided adhesive tape attached to the base member 12.

If the door anti-latch device 10 will be mounted using an adhesive, the installer can clean the door and jamb surfaces before installing the device (see FIGS. 8D and 8E). For the IL and IR configurations, the base member 12 is mounted to the door edge with the base flange 18 abutting tightly against the door's outside face edge (see FIG. 8F). For the OL and OR configurations, the base member 12 is mounted to the door-jamb with the base flange 18 abutting tightly against the jamb's stop edge (see FIG. 8G). After the base member 12 is mounted, the door can be closed to mark where the lever stop end 24 will touch the door or the jamb stop. A protective pad, such as a peel-and-stick pad, can be attached to the door or jamb where the lever stop end 24 touches it (see FIGS. 8H and 8I). Preferably a label, such as peel-and-stick label, is then placed on the door jamb inside the room showing a user that the door anti-latch device 10 is in the "Normal" position (i.e., the door-open position) when the lever handle 25 is rotated up and is in the "Lockdown/Fire" position (i.e., the latching position) when the lever handle 25 is rotated down (see FIGS. 8J and 8K).

After the door anti-latch device 10 has been installed, it can be operated from inside the room and can allow the room door to remain locked at all times. When the door is closed, the preferred embodiment of the door anti-latch device 10 shown in FIGS. 1-5 prevents the door from latching by stopping the door approximately ⅜ of an inch from the jamb stop when the lever is in the "Normal" or door-open position. People can then enter and exit the room without having to depress the door lever handle or turn the door knob.

Pulling the lever into the "Lockdown/Fire" or latching position allows the door to latch, thereby locking the door. When the door needs to be locked, such as in the event of a lockdown or fire emergency requiring a locked door, the user can pull the lever into the "Lockdown/Fire" position and push or pull the door shut to secure the room.

From the foregoing, it will be seen that there are numerous advantages to and benefits of the present invention. An anti-latch device according to the invention can be installed on a classroom door to quickly and easily secure the door from inside the classroom during a lockdown. It eliminates both the burden and the risk of having to exit the room to lock the door from the outside by allowing the door to be closed and locked at all times. The device can prevent the door from latching until the lever is pulled to allow the door to latch. This can be done without leaving the classroom or opening the door. With the invention, securing the classroom and the building can be done easily and quickly, with little, if any risk. An anti-latch device according to the invention is inexpensive and easy to install. The device is inconspicuous and can be installed high enough up on the door to discourage children from playing with it. The device can be easily and inexpensively manufactured in versions for use with a right hand or left hand door, whether the door opens into the room, into the hallway, or to the outside.

Upon reading this disclosure, those skilled in the art will appreciate that various changes and modifications may be made to the preferred embodiments of the invention and that such changes and modifications may be made without departing from the spirit of the invention. Therefore, the invention in its broader aspects is not limited to the specific details, representative devices, and illustrative examples shown and described. Accordingly, departures may be made from such details without departing from the spirit or scope of the general inventive concept.

What is claimed is:

1. A door anti-latch device for preventing a door from latching, the device comprising:

a base;

means for mounting the base to a door or a door frame; and a lever rotatably mounted to the base so that the lever can rotate about a pivot point from a blocking position to a non-blocking position, the lever including a handle end and an opposing stop end, wherein the pivot point is positioned between the ends of the lever;

wherein the lever can be rotated between the open position and the non-blocking position by moving the lever handle end;

the lever rotation is in a plane that is generally perpendicular to a door jamb stop surface and generally parallel to a door jamb side surface; and wherein, when the base is mounted to the door or door frame, the lever stop end will prevent the door from latching when the lever is in the blocking position and will not prevent the door from latching when the lever is in the non-blocking position.

2. The door anti-latch device of claim 1 wherein the base comprises a plate.

3. The door anti-latch device of claim 1 wherein the base includes a flange opposite the pivot point for contacting an edge of the door or door frame.

4. The door anti-latch device of claim 1 wherein the lever comprises a plate.

5. The door anti-latch device of claim 1 wherein:

the base and the lever are generally elongated; and the lever is generally parallel to the base in the open position and is generally perpendicular to the base in the latching position.

6. The door anti-latch device of claim 1 wherein the lever is rotatably mounted to the base with a rivet.

7. The door anti-latch device of claim 1 wherein the means for mounting the base to the door or the door frame comprises an adhesive tape mounted to the base.

8. The door anti-latch device of claim 1 wherein the base includes a projection for restricting the rotation of the lever to a range between the open position and the latching position.

9. The door anti-latch device of claim 8 wherein the lever includes a shoulder that cooperates with the base projection for restricting the range of rotation of the lever.

10. The door anti-latch device of claim 8 wherein the range of rotation is approximately 90 degrees.

11. A door anti-latch device for preventing a door from latching with a door frame, comprising in combination:

a base mounted to the door or the door frame; and a lever rotatably mounted to the base so that the lever can rotate about a pivot point from blocking position to a non-blocking position, the lever including a handle end and an opposing stop end, wherein the pivot point is positioned between the ends of the lever;

wherein when the door is closed with the lever in the open position, the lever can be rotated from the blocking position to the non-blocking position by moving the lever handle end without opening the door;

wherein the lever stop end contacts the door frame or the door and prevents the door from latching when the lever is in the blocking position; and wherein the lever stop end does not prevent the door from latching when the lever is in the non-blocking position.

12. The combination of claim 11 wherein base comprises a plate.

13. The combination of claim 11 wherein the base includes a flange opposite the pivot point that abuts the door or the door the door frame.

14. The combination of claim 11 wherein the lever comprises a plate.

15. The combination of claim 11 wherein:

the base and the lever are generally elongated; and the lever is generally parallel to the base in the open position and is generally perpendicular to the base in the latching position.

16. The combination of claim 11 wherein the base is mounted to the door or the door frame with an adhesive tape.

17. The combination of claim 11 wherein the base includes a projection that restricts the rotation of the lever to a range between the open position and the latching position.

18. The combination of claim 17 wherein the lever includes a shoulder that cooperates with the base projection for restricting the range of rotation of the lever.

19. The combination of claim 11 wherein the range of rotation is approximately 90 degrees.

20. A door anti-latch device for preventing a door from latching, the device comprising:

a base plate defining a pivot point and including a flange opposite the pivot point for contacting an edge of a door or door frame;

means for mounting the base plate to the door or door frame, and a lever plate including a handle end and an opposing stop end and rotatably mounted to the base so that the lever plate can rotate about the pivot point from blocking position to a non-blocking position by moving the lever handle end, wherein the lever plate rotation is in a plane that is generally perpendicular to a door jamb stop surface of the door frame and generally parallel to a door jamb side surface of the door frame;

wherein the pivot point is positioned between the lever handle end and the stop end;

wherein the lever stop end engages the door frame or the door and prevents the door from latching when the lever is in the blocking position; and wherein the lever stop end does not engage the door or door frame and does not prevent the door from latching when the lever is in the non-blocking position.

* * * * *